US009868585B2

(12) United States Patent
Bates

(10) Patent No.: US 9,868,585 B2
(45) Date of Patent: Jan. 16, 2018

(54) WEDGE SHAPED FOOTWEAR HOLDER

(71) Applicant: Nicola Jane Bates, Dorset (GB)

(72) Inventor: Nicola Jane Bates, Dorset (GB)

( * ) Notice: Subject to any disclaimer, the term of this patent is extended or adjusted under 35 U.S.C. 154(b) by 21 days.

(21) Appl. No.: 14/899,202

(22) PCT Filed: Jun. 18, 2014

(86) PCT No.: PCT/GB2014/000239

§ 371 (c)(1),
(2) Date: Dec. 17, 2015

(87) PCT Pub. No.: WO2014/202937

PCT Pub. Date: Dec. 24, 2014

(65) Prior Publication Data

US 2016/0145035 A1 May 26, 2016

(30) Foreign Application Priority Data

Jun. 18, 2013 (GB) ..... 1310828.7

(51) Int. Cl.

| | |
|---|---|
| ***B65D 5/46*** | (2006.01) |
| ***B65D 85/18*** | (2006.01) |
| ***B65D 21/08*** | (2006.01) |
| *A45C 3/12* | (2006.01) |

(52) U.S. Cl.
CPC ..... *B65D 85/187* (2013.01); *B65D 21/086* (2013.01); *A45C 3/12* (2013.01); *B65D 2205/02* (2013.01)

(58) Field of Classification Search
CPC ..... A45C 13/03; A45C 3/004; B65D 85/18; B65D 77/26; B65D 85/182; E01F 9/012
USPC ..... 206/292, 278, 295, 749, 756; 211/35; 383/38; 116/63 C
See application file for complete search history.

(56) References Cited

U.S. PATENT DOCUMENTS

| | | | | |
|---|---|---|---|---|
| 2,104,828 A * | 1/1938 | Brinnon | B65D 5/48048 206/278 |
| 2,990,960 A * | 7/1961 | Rafferty | A47L 23/20 211/35 |
| 3,360,112 A * | 12/1967 | Johnson | B65D 85/187 206/295 |
| 4,266,668 A * | 5/1981 | Paek | A47J 47/12 206/557 |

(Continued)

FOREIGN PATENT DOCUMENTS

| | | |
|---|---|---|
| CN | 87 2 09619 | 6/1988 |
| CN | 2322934 | 6/1999 |

(Continued)

OTHER PUBLICATIONS

International Search Report dated Apr. 9, 2014 in corresponding (PCT) International Application No. PCT/GB2014/000239.

*Primary Examiner* — Fenn C Mathew
*Assistant Examiner* — Cynthia Collado
(74) *Attorney, Agent, or Firm* — William H. Bollman

(57) ABSTRACT

The present invention provides a wedge shaped footwear holder having two sides, a top and a floor, in which the sides and a top taper to define a closed distal end. A proximal opening accepts a displaceable portion. The displaceable portion is moveable along a neck, and is capable of being fixed in different positions so as to adjust an internal length of the footwear holder to correspond to a shoe.

14 Claims, 8 Drawing Sheets

(56) References Cited

U.S. PATENT DOCUMENTS

| | | | | |
|---|---|---|---|---|
| 5,076,437 | A * | 12/1991 | Schindler | A45C 11/20 206/508 |
| 6,951,277 | B1 * | 10/2005 | Meynard | B65D 5/5021 190/13 F |
| 7,597,193 | B2 | 10/2009 | Meynard | |
| 8,499,955 | B2 * | 8/2013 | Vazquez | A47F 7/08 190/100 |
| 2004/0237875 | A1 * | 12/2004 | Garcia | E01F 9/688 116/63 C |
| 2007/0039840 | A1 * | 2/2007 | Mu | B65D 5/38 206/278 |
| 2013/0118929 | A1 * | 5/2013 | Behar | B65D 5/4802 206/278 |

FOREIGN PATENT DOCUMENTS

| | | |
|---|---|---|
| CN | 201172516 | 12/2008 |
| CN | 202346164 | 7/2012 |
| DE | 41 07 584 | 9/1992 |
| DE | 42 09 669 | 9/1993 |
| GB | 519820 | 4/1940 |
| JP | 47-28147 | 11/1972 |
| JP | 47-28148 | 11/1972 |

* cited by examiner

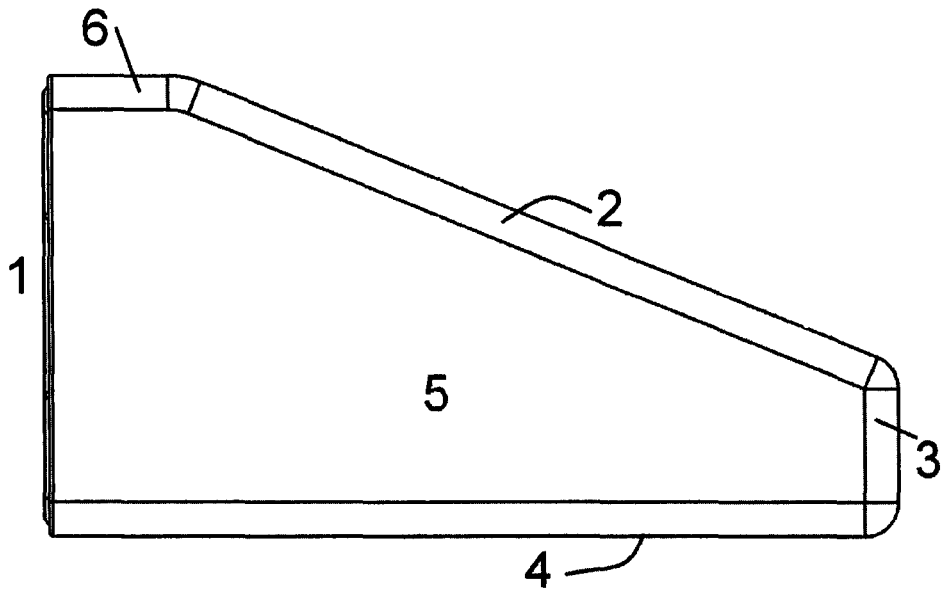
fig.5a
fig.5b
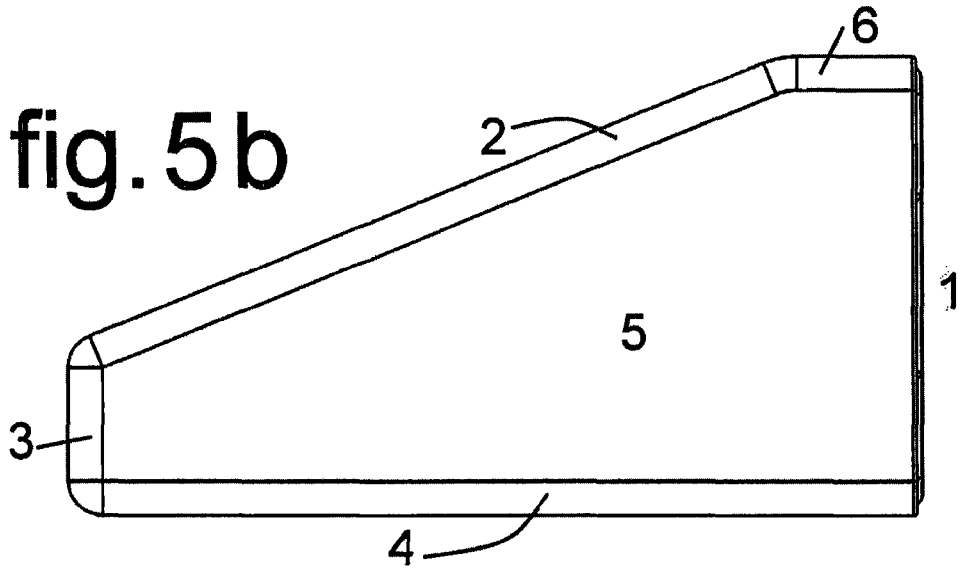

WEDGE SHAPED FOOTWEAR HOLDER

FIELD OF THE INVENTION

The present invention relates to a wedge shaped footwear holder, more particularly but not exclusively a rigid wedge shaped footwear holder for protecting a shoe.

BACKGROUND

It is usual for a person to have a number of pairs of different shoes. Often there is a requirement to take more than one pair of shoes when travelling, even if only for a short time. However space in travel luggage may be limited, or restricted, for example if relying on hand-luggage allowances.

When storing or transporting shoes many users will wish to contain them in some way, such as a box or bag in order to prevent damage, such as becoming scratched, crushed or scuffed and to prevent them from soiling other items, for example clothing that may be packed in the same luggage as the footwear.

However, shoes may rub against another when stored together, for example in a shoe box or bag. Furthermore some forms of covering such as a bag do not provide enough protection. Other protective coverings such as a shoe box can take up considerable space, particularly in a travel case, making it difficult to fit in other items and in some cases being too large to fit in a travel case.

PRIOR ART

Accordingly a number of patent applications have been filed in an attempt to resolve the problem or similar, including the following:

Chinese utility model CN 202 346 164 (Zhou et al) relates to a shoe box. Both sides of the shoe box are right-angle trapezoid; a bevelling surface formed corresponding to the right-angle trapezoid is located at one end of the shoe box close to the box cover; a shell-like box cover is arranged on the bevelling surface; a square opening convenient for hands to put in is arranged on the bottom of the shoe box longer than the upper surface; and the box body inside the box cover is matched with the box cover.

Chinese utility model CN 201 172 516 (Danhe) relates to a transparent single-hand flip cap shoe box, comprising a body and a cover, which is characterized in that the bottom of the body is composed of two slots following the shoe form, the connection part of the two slots is in a n-shaped form, the cover is connected with the body via an interlocking hinge, the middle concave of the body at one end of the interlocking hinge is provided with a finger hole plate, the middle concave of the cover corresponding to the finger hole plate is provided with a finger ring plate.

U.S. Pat. No. 7,597,193 (Meynard) discloses a shoe box formed of a single die-cut piece of material folded along a plurality of score lines, sized and shaped to receive a pair of shoes, said box having parallel side and parallel end walls and a bottom interconnecting the walls, a divider for separating a pair of shoes positioned lengthwise of the shoe box, said divider positioned inwardly from one end wall and between the opposed side walls, with at least a portion of the divider having side edges spaced from the side walls, and with the divider lying at least in part in a plane extending between the side walls substantially parallel to the bottom of the shoe box, and with at least a panel of the divider adapted to contact and separate a pair of shoes, and wherein said divider is integrally formed with the single die-cut piece of material.

Chinese utility model CN2322934Y (Wenzhou) discloses a simple shoe box provides a shoe, comprising a transparent plate main body and provided with a base sheet in the appropriate place of the transparent plate, characterised in that: the appropriate place of the transparent plate are provided on the plate, side plate, the front plate and the back plate.

Chinese utility model CN87209619U (Yang) discloses a novel shoe box capable of collapsing.

German patent application DE4209669 A1 (Zetz) discloses a transport and storage container for sports shoes, the container having drying material.

Japanese utility model JP47 28147 01 (Muratsubaki) discloses shoe storage case having a container and a cover of transparent or semi-transparent plastic, the container and cover removably mounted with a rope having elasticity such as a spring and a desiccant and a deodorant within part of the cover.

Japanese utility model JP47 28148 01 (Muratsubaki) discloses a shoe storage case, the case made of plastic and having an opening on its one end, a cover having a transparent window is removable mounted on the opening, part of the case provided with a small chamber having a large number of opening holes machine on the bottom surface part of the case and desiccant and deodorant are stored in the small chamber.

In contrast to the foregoing, the present invention provides a means of storage for shows that can be adapted to particular shoes to provide protection.

SUMMARY OF THE INVENTION

According to the present invention there is provided a wedge shaped footwear holder comprising: two sides, a top and a floor, in which said sides and a top taper to define a closed distal end, a proximal opening for accepting a displaceable portion that serves to close footwear within the holder wherein the displaceable portion is moveable along a neck, the displaceable portion is capable of being fixed in different positions so as to adjust internal length of the footwear holder to correspond to a shoe.

The holder is wedge shaped so as to be dimensioned to match the basic shape of footwear in order to avoid excess empty space within the holder and to restrict movement of the footwear/shoe within the holder in transport and storage that may cause damage.

Typically the floor is planar and the displaceable portion is substantially orthogonal relative to the floor.

In some embodiments the floor may formed with arcuate, curved, bowed, bent and/or stepped shaping to echo a lower face of an item of footwear such as a heel or tread.

The displaceable portion is displaced so as to allow the shoe to be added or removed. The displaceable portion is replaced so as to close the holder therefore containing the footwear within the holder.

It may be envisaged that the footwear holder is for storing men, women or children's footwear.

The holder serves to prevent the shoe or shoes becoming crushed or damaged during transport. For example the shoe may be located in the holder and then positioned within a suitcase with other items. In this way the item of footwear is held separately from other items.

Preferably the footwear holder is adapted to receive a single shoe. In this way holders can be positioned at different locations in the suitcase assisting with packing. For example a wearer will have a pair of holders for a pair of shoes and may locate each holder in a different corner of a travel case so as to provide more packing options.

It is appreciated that the dimensioned of the wedge shaped footwear holder may be varied in order to correspond to different shoe types, for example to accommodate flat shoes, heeled shoes or boots. For example in some embodiments the holder may be adapted to hold a boot wherein the holder is lengthened so as to accommodate the boot upper.

As the holder is wedge-shaped it is adapted to accommodate a toe and heel region of a shoe, wherein the toe region of the shoe is positioned at the closed distal end of the holder.

It may be envisaged that the dimensions of the footwear holder may accommodate footwear such as footwear that has a flat sole such as a 'flip-flop', loafer, sport shoe or pump, or footwear with an elevated or raised heel shoe such as a platform, wedge or stiletto.

In preferred embodiments the holder is substantially or wholly formed of rigid material. In this way the holder maintains the wedge shaped form during use. This prevents damage to footwear stored inside the holder and the holder is prevented from being crushed when located in a container such as luggage with other items or a confined space such as a shoe rack.

In some embodiments the holder may be provided with structural strengthening or internal bracing so as to aid with maintaining the wedge shape of the holder.

In preferred embodiments all corners of the holder are rounded so as to have no sharp edges that may cause discomfort to a user or damage to surrounding objects.

Arrangement or placement of the displaceable portion is adjustable along the neck so as to permit different size shoes to be located in the holder wherein the position of the displaceable portion is adjusted to be close to or to abut the footwear therefore avoiding excessive movement of shoes inside of the holder.

The neck is elongate to as to allow movement of displaceable member along the next so as to alter proximity to the shoe contained within.

The displaceable portion is capable of arrangement at plural positions along the neck so as to accommodate different sizes of footwear.

Typically the opening comprises a square or rectangular opening for receiving a square or rectangular displaceable portion, as appropriate, so as to be dimensioned to fit the opening in such a way that the opening is closed by fitting of the displaceable portion.

The displaceable portion may be fitted to the holder by a detent mechanism, tolerance or friction fit.

Preferably the displaceable portion is locked in position by alignment of corresponding mating parts. For example the holder may include an aperture, cut away or recess for receiving a corresponding projection arranged on the displaceable portion or vice-versa.

In this way when corresponding projections and recesses are aligned so that the displaceable portion becomes locked to the holder.

Typically the shape of the projection matches that of the recess in order to permit a secure connection. Preferable the recess and projection are rounded, for example being round or oval shaped so as to have no sharp edges that may damage a shoe or injure a user.

In some other embodiments the recess and projection may be triangular, square, rectangular, hexagonal or other multi-angled shapes.

Preferably the displaceable portion is formed from a resiliently deformable material so as to be capable of flexure to disengage projections arranged on the displaceable from recesses arranged on the neck of the holder.

In preferred embodiments the displaceable portion includes projections arranged about an outer edge that in use are accepted in the recesses, apertures or cut outs provided on the sides, top or floor of the holder. In this way the displaceable portion can be locked into place on the holder by locating the projections within the recesses.

Preferably the neck includes at least one recess, aperture or cutaway on a pair of opposite or parallel sides and accordingly the displaceable portion includes at least two projections located on distal sides or edges of the displaceable portion, that in use correspond with the recesses on the body.

Ideally the neck may include a row of recesses, apertures or cutaways arranged along the neck length so that the displaceable portion may be placed at different positions along the neck that results in the internal length of the holder being altered so as to correspond to the footwear.

In this way the displaceable portion can be inserted to different depths within the neck so as to alter the internal dimensions of the holder and the internal length can be reduced so as to securely house a smaller shoe. For example therefore the recesses may be arranged to correspond with shoe sizes.

In some embodiments the apertures, recesses or cutaways may be marked, for example with a number so as to indicate shoe size. In this way the displaceable portion can be moved to a pre-determined mark that corresponds to shoe size.

Furthermore the recesses, apertures or cutaways may be colour coded so as to easily ensure each projection is correctly aligned.

Typically the displaceable portion maybe formed from a cellular structure such as foam or an elastic material such as rubber in order to permit flexure of the displaceable portion to allow the projections to be disengaged.

Preferably the displaceable portion includes finger grips that define a handle so as to allow a user to position their fingers securely on the displaceable portion in order to flex it so as to enable fitting, removal and repositioning. For example the displaceable portion may include two spaced apart finger grips so as to allow the user's fingers to be located therein to accomplish a pinching movement that causes the displaceable portion to flex.

In other embodiments the displaceable portion includes retractable projections and a locking or closure mechanism by which the projections may be retracted, or released.

In such embodiments the displaceable portion may be substantially rigid, being formed for example from a synthetic plastic as it is not necessary for the displaceable portion to flex in order to disengage the projections.

Ideally such a mechanism for retracting the projections may comprise a button, lever or control that can be pressed, pushed or activated so as to retract the projections and enable the displaceable portion to be displaced. When in the desired location the control can therefore be released to extend the projections, thereby allowing the projections to engage with the recesses. For example the displaceable portion may include an indent on each side that houses a button linked to the projections which when depressed retracts the projections and in this way the user may use their hands typically employing a finger and thumb to simultaneously press the buttons so as to retract both projections.

Advantageously the resiliently deformable displaceable portion may form a seal with the body when closed so as to protect the footwear, for example restricting entry of liquids or rain. Advantageously this may allow shoes to be displayed outside without becoming damaged.

In some embodiments the displaceable portion may include a resiliently deformable, outwardly mounted O-ring so as to form a seal with the holder, wherein for example the O-ring may be formed from rubber or silicone.

In some other embodiments the displaceable portion may comprise a plate that is hinged at a hinge on or from the body.

In other embodiments the displaceable portion comprises a plate arranged to slot into the holder in at least one location so as to close the holder. For example the neck may include a channel into which the displaceable portion can be slotted so as to close the holder.

Typically multiple channels are provided so that the position of the displaceable portion can be altered to change internal length of the holder.

In some embodiments the internal dimensions may not be adjustable and instead the holder may be provided in particular shoe sizes.

In some embodiments a face other than the proximal face, such as the side, floor or top may provide the opening for receiving the displaceable portion.

For example the upper may be hinged, clipped or fitted together by mating or interlocking parts.

In yet further embodiments two or more sides may include openings.

In preferred embodiments the holder also includes at least one vent so as to allow circulation of air. In this way air can be allowed to circulate the shoes even when the holder is closed.

The vent typically comprises at least one aperture so as to permit entrance of air to holder and therefore about the footwear inside.

In some embodiments the holder may be airtight with no air or ventilation holes or apertures.

Ideally the vent can be opened and closed so as to control airflow. Advantageously this may prevent the holder being affect by different air pressures, for example when in an aeroplane.

For example the vent may include a flap(s) to close the vents.

In some embodiments the vent may comprise a dial that can be turned to so as to open and close the vent or vents therefore allowing the holder to be breathable but also being discreet. Typically the vent is provided on the displaceable portion.

In preferred embodiments at least part of the holder is transparent or translucent so as to be able to see the footwear within the holder. For example one or more faces of the body may be transparent or the displaceable portion may be transparent.

Alternatively a viewing window may be provided on one or more faces of the holder. Therefore the footwear can be readily identified without requirement to remove the displaceable portion.

It may be envisaged that the holder may also serve to protect the footwear from sun damage, for example from becoming faded if displayed in a shop window, wherein the holder material is partly or wholly ultraviolet ray blocking.

Ideally the holder may be formed from a lightweight, durable material such as synthetic plastic.

In preferred embodiments the holder is manufactured through a moulding process. For example the holder may be formed in two halves that are joined together for example by adhesive of bonding in order to provide the holder as a single part.

Preferably the holders may be formed from recycled materials.

In other embodiments the holder may be formed from compressed or pulped paper, board or cardboard material so as to produce a lightweight, or low cost version, such as for single-use. Said material may comprise recycled matter.

In some embodiments the holder may be collapsible and/or provided flat packed so that it can be assembled for use and collapsed when not in use. In this way the holder may be stored and transported easily pre- or post-purchase or use.

In some embodiments the holder and or displaceable portion may be coloured and/or patterned so as to provide varied appearance for different users and/or different types of footwear. It may be envisaged that the holder may also be etched or embossed to display a pattern, text or an image, for example a logo.

In some embodiments the holder may be dimensioned to hold two or more shoes. This may be enabled wherein the holder accepts a divider so as to separate one shoe from another within the holder so as to protect each shoe from rubbing against another.

The divider may be displaceable wherein the holder may include receiving means for receiving the divider, such as rails into which the divider can be slid so as to define separate compartments.

Preferably the inner faces of the holder and the displaceable portion that interface the footwear have a smooth finish so as prevent any damage such as scratching or scuffing to the footwear. In some embodiments the holder and/or displaceable portion may include a soft liner, such as a fabric finish to prevent damage. For example patches of fabric may be provided to correspond to a toe end and a heel end of the shoe.

In some embodiments the inner faces of the shell and/or front may include padding so as to cushion the footwear within the holder to prevent damage and to limit movement of the footwear in use. For example the inner face may include a transparent gel layer to cushion the shoe.

Preferred embodiments of the invention will now be described, by way of examples only, and with reference to the Figures in which:

BRIEF DESCRIPTION OF FIGURES

FIG. 5 show side views of the embodiment shown in FIG. 1;

DETAILED DESCRIPTION OF FIGURES

With reference to the figures there is disclosed a wedge shaped footwear holder 100.

Figure 1:
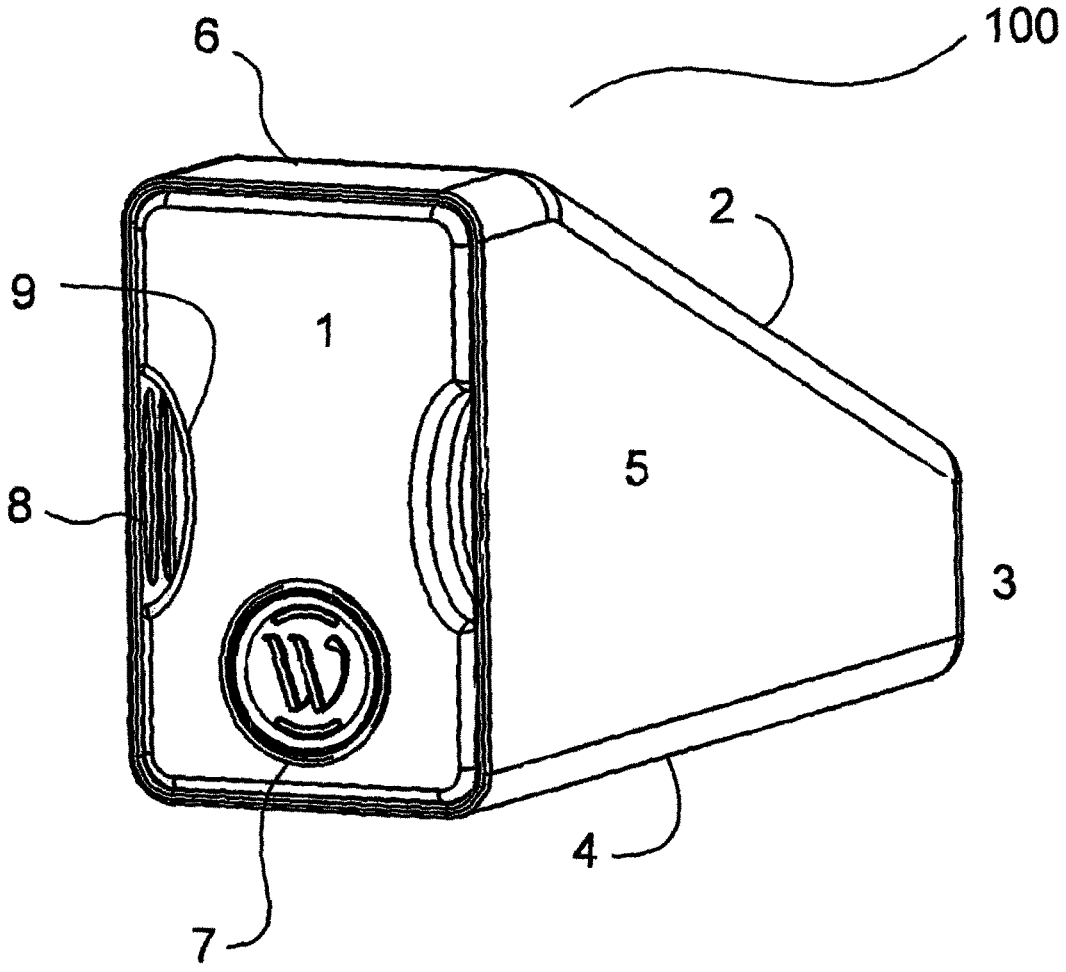
FIG. 1 shows an isometric view of a preferred embodiment of the footwear holder.
Figure 2:
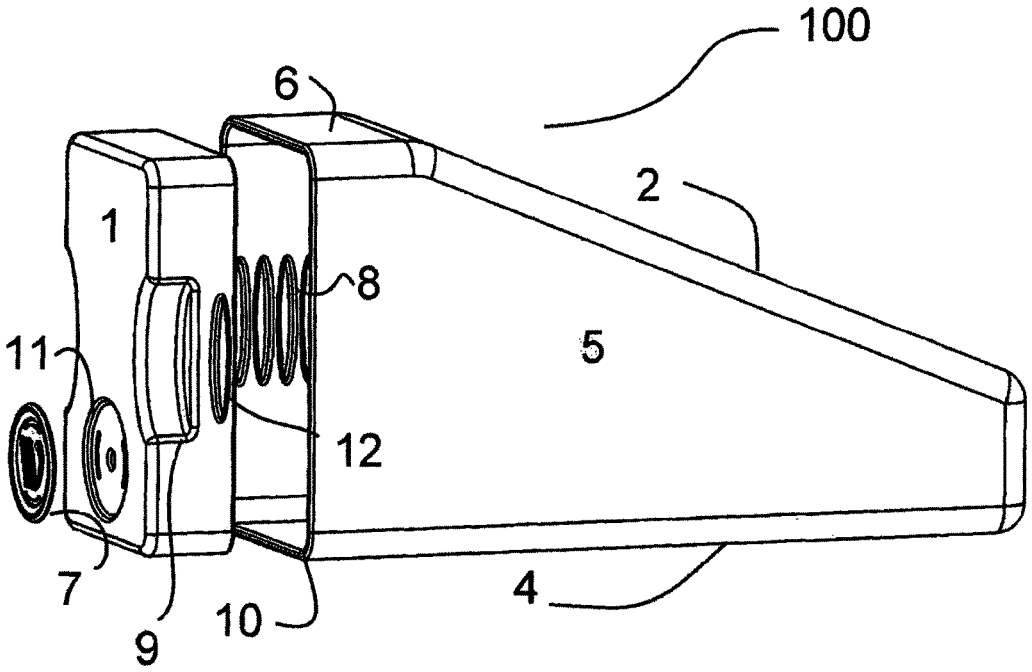
FIG. 2 shows an exploded view of the embodiment shown in FIG. 1.
Figure 3:
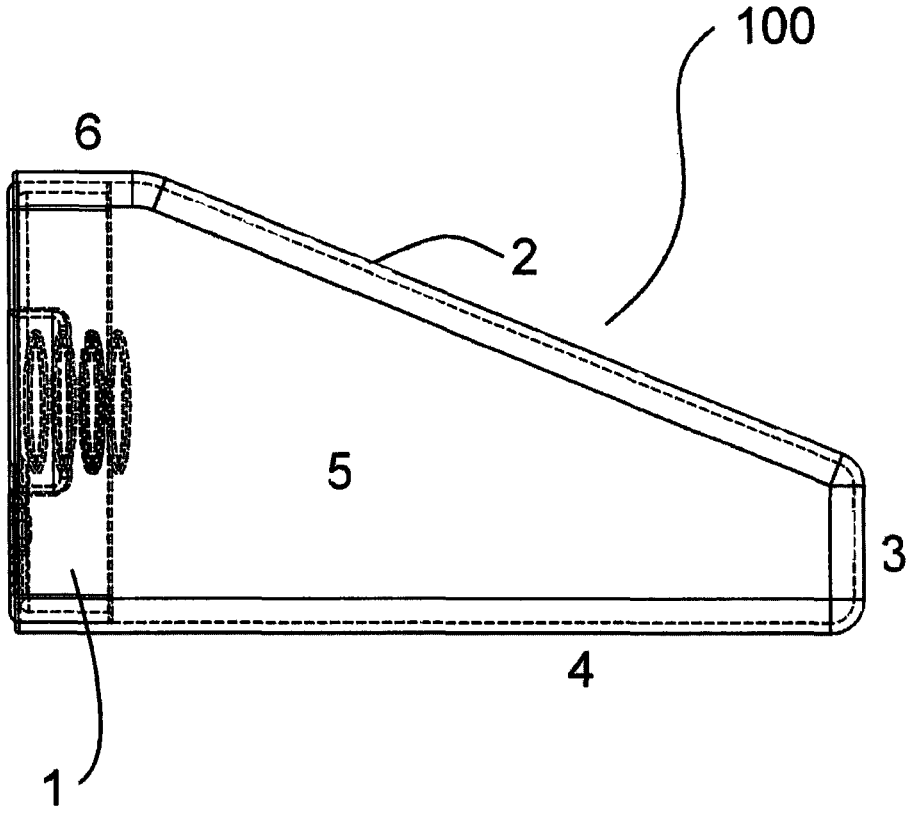
FIG. 3 shows a side view of a transparent embodiment of the footwear holder.
Figure 4:
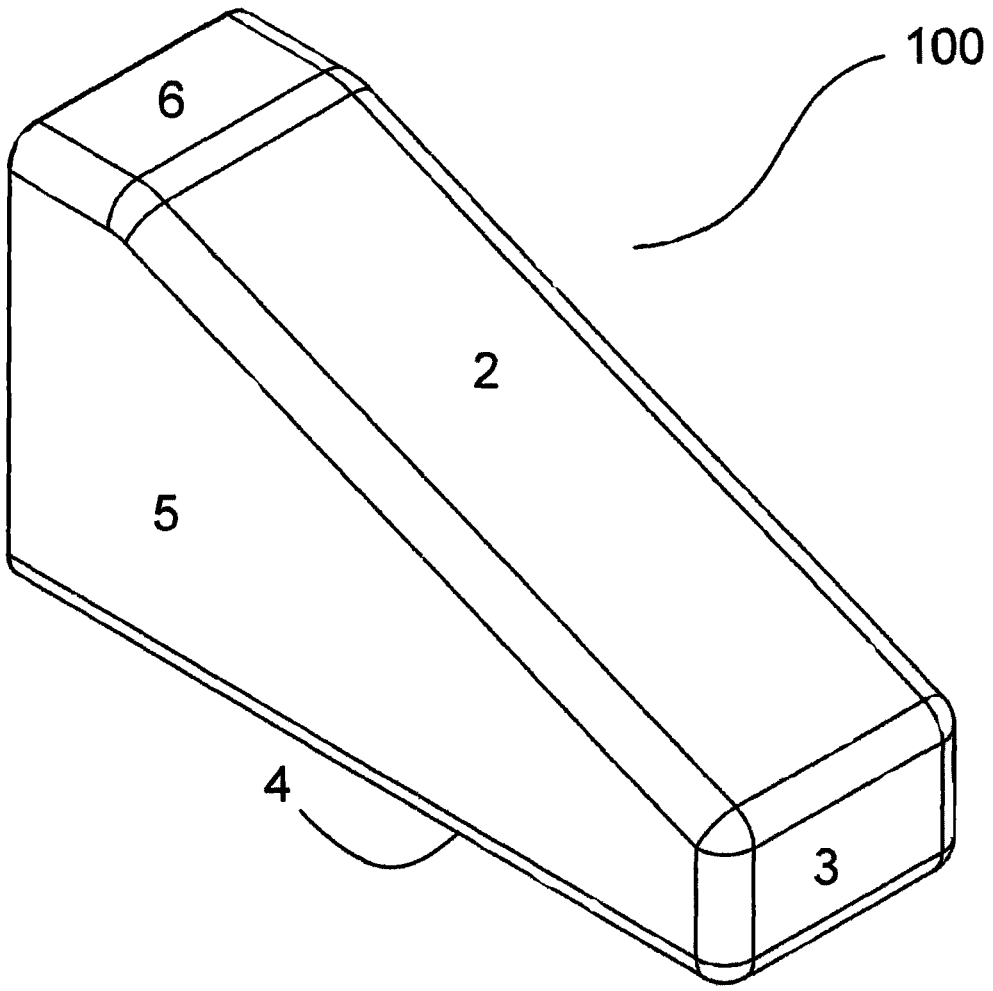
FIG. 4 shows a reverse isometric view of the embodiment shown in FIG. 1.
Figure 6A:
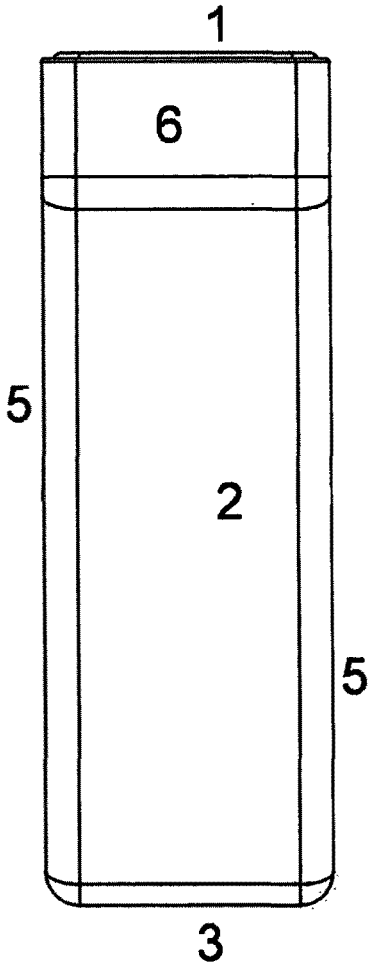
FIG. 6 show plan views of the embodiment shown in FIG. 1.
Figure 6B:
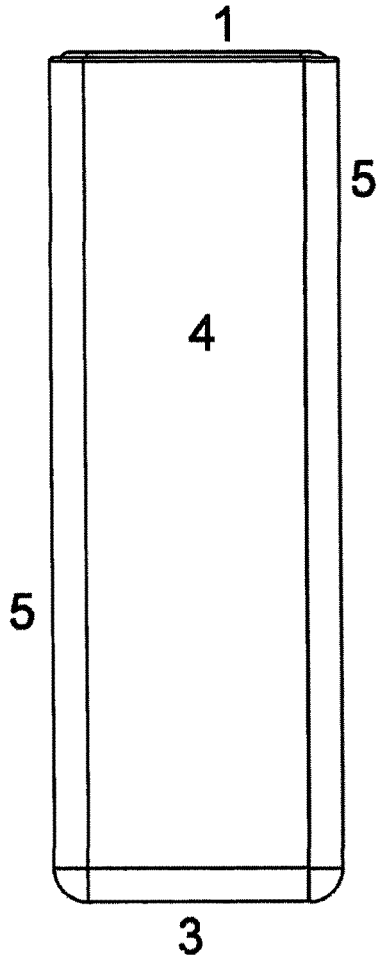
Figure 7A:
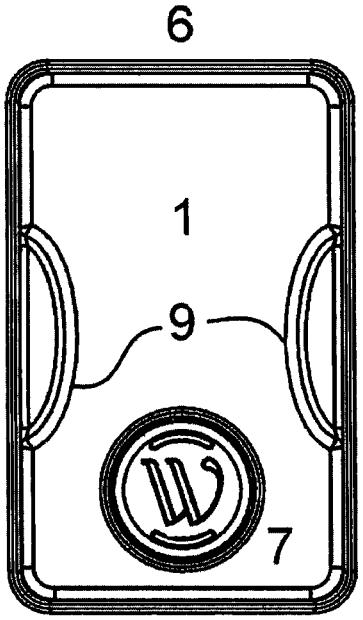
FIG. 7 show end views of the embodiment shown in FIG. 1.
Figure 7B:
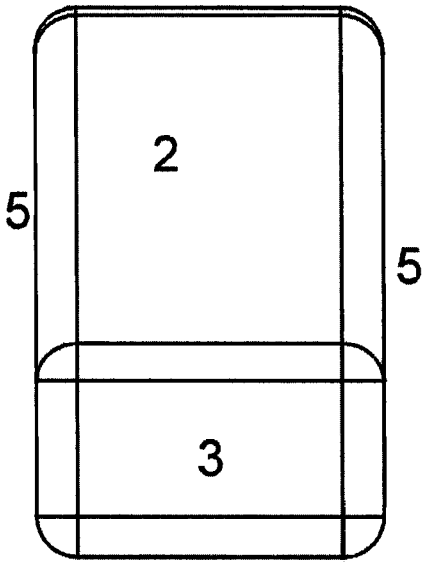
Figure 8:
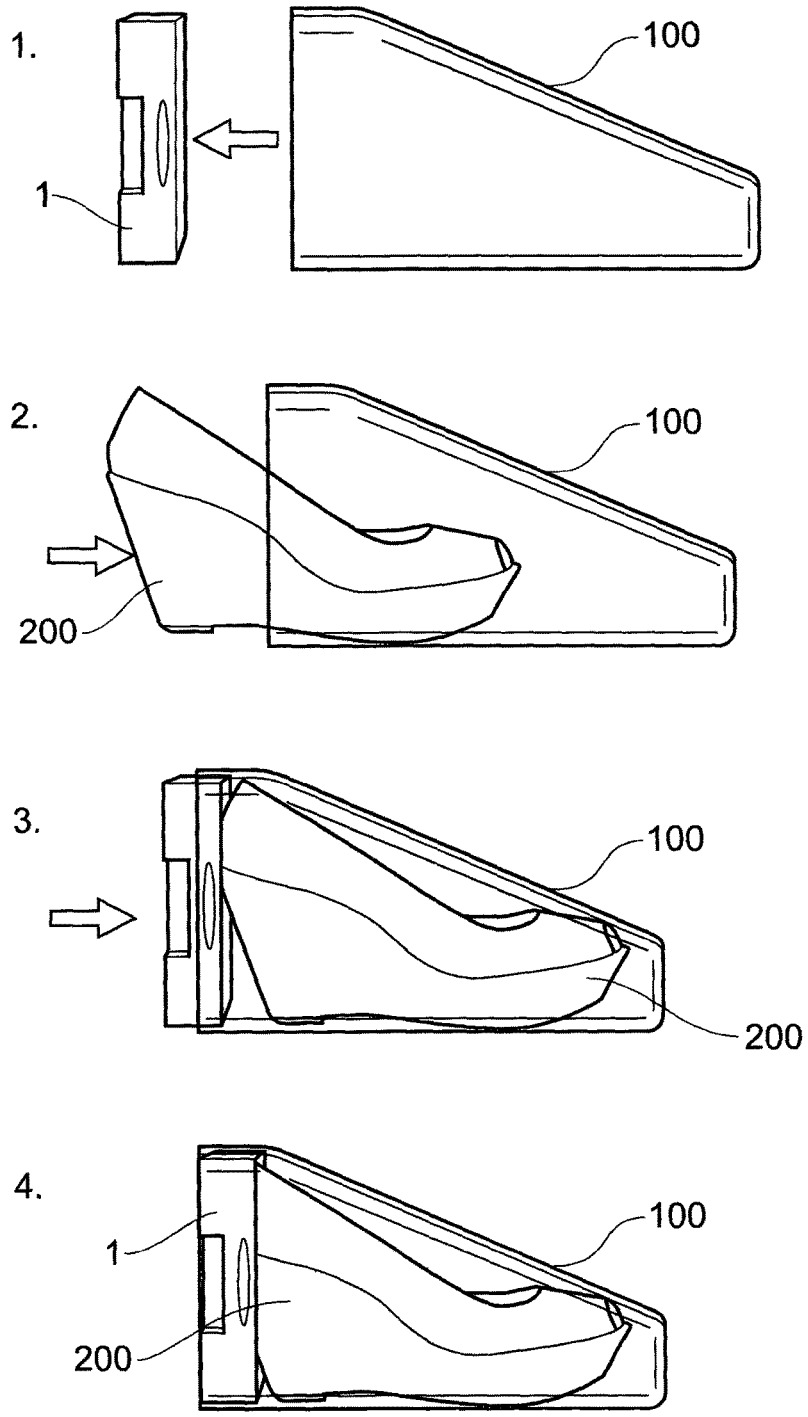
FIG. 8 shows the process of placing a shoe within a holder.

FIGS. 1-8 disclose a first embodiment of the holder 100 having a displaceable portion 1 arranged in an opening 10 at a proximal end of the holder 100.

The holder 100 has a floor 4 and a pair of opposing sides 5 that extend perpendicular from the floor 4. The floor 4 and the two sides 5 connect to a top 2 so as to form the wedge shaped holder 100.

The distal end 3 of the holder 100 corresponds to where a toe region of a shoe will be located in use. Therefore the item of footwear 200 is entered into the holder 100 toe first.

The displaceable portion 1 serves to close the holder 100 when the item of footwear 200 is stowed within it.

The displaceable portion 1 may be removed from the holder 100 in order to access and remove items of footwear 200.

The opening 10 comprises a neck 6. The neck 6 is an elongate channel for receiving the displaceable portion 1 along which the displaceable portion 1 can be positioned at different locations in order to alter internal length of the holder 100.

The displaceable portion 1 is inserted into the neck 6 so as to abut the shoe 200 or to be in near contact with the shoe 200 so as to limit or prevent movement of the shoe 200 within the holder 100.

The neck 6 includes a series of recesses 8 for receiving the projections 12. In this way when a projection 12 is aligned with a recess 8 the displaceable portion 1 becomes locked in the neck 6.

The recesses 8 are oval shaped and receive an oval, dome shaped projection 12.

The displaceable portion 1 can be slid along the neck 6 to various positions in order to alter internal length of the holder 100.

A projection 12 is released from the corresponding recess 8 by flexing the displaceable portion 1 so as to disengage the projections 12 from the recesses 8.

The displaceable portion 1 is formed from a strong, durable, resiliently deformable material so as to be suitable for repeated flexure during use.

The displaceable portion 1 is flexed by a user positioning their fingers at finger grips 9 so that the when pinched together the displaceable portion 1 flexes so as to disengage the projection 12 from the recess 8.

There are two finger grips 9 provided on an outer face of the displaceable portion 1. Each finger grip 9 is an indentation created an outer face of the displaceable portion 1.

Each finger grip 9 is a semi-circular indent shaped to receive the user's fingers. The fingers grips 9 are provided on edges of opposing sides of the displaceable portion 1, in the form of a cut away edge, so as to enable the displaceable portion 1 to be easily flexed when force is applied by the user pinching the handles.

In some embodiments the finger grips 9 may not be provided at an edge.

The displaceable portion 1 also includes one ventilation hole 11 that can be opened and/or closed by rotation of the dial 7. This allows circulation of air into the holder even when the holder is closed by the displaceable portion 1.

The invention has been described by way of examples only and it will be appreciated that variation may be made to the above-mentioned embodiments without departing from the scope of invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, suitable modifications and equivalents are considered to fall within the scope of the claims appended hereto.

The invention claimed is:

1. A wedge shaped footwear holder comprising:

two sides, a top and a floor, in which said sides and a top taper define a closed distal end, a non-tapered neck opposite the closed distal end, and a proximal opening adjacent to the non-tapered neck and accepting a displaceable portion, the proximal opening of the non-tapered neck being orthogonal to the floor, wherein the displaceable portion is moveable along the non-tapered neck, wherein the displaceable portion is adapted to be selectively fixed in any one of a plurality of different positions so as to adjust an internal length of the floor of the footwear holder to correspond to a shoe; and wherein at least one of the displaceable portion and the neck is resiliently deformable so as to be capable to flexure to enable engagement and disengagement of the displaceable portion from one of the plurality of different positions to another.

2. The wedge shaped footwear holder according to claim 1 shaped for receiving an individual shoe.

3. The wedge shaped footwear holder according to claim 1 wherein the wedge shaped footwear holder is substantially or wholly formed of rigid material.

4. The wedge shaped footwear holder according to claim 1 wherein the displaceable portion includes finger grips for locating a user's hand whilst engaging and disengaging the displaceable portion in the wedge shaped footwear holder.

5. The wedge shaped footwear holder according to claim 1 wherein at least part of the wedge shaped footwear holder is transparent so as to be able to view the footwear within the wedge shaped footwear holder.

6. The wedge shaped footwear holder according to claim 1, further comprising:

a vent to permit ingress of air to the footwear inside.

7. The wedge shaped footwear holder according to claim 1 wherein at least part of the wedge shaped footwear holder is translucent so as to be able to view footwear within the wedge shaped footwear holder.

8. The wedge shaped footwear holder according to claim 1 wherein the non-tapered neck includes a plurality of recesses corresponding to the plurality of different positions for the engagement with the displaceable portion.

9. A wedge shaped footwear holder comprising:

two sides, a top and a floor, in which said sides and a top taper define a closed distal end, and a proximal opening accepting a displaceable portion, wherein the displaceable portion is moveable along a neck, wherein the displaceable portion is capable of being fixed in different positions so as to adjust internal length of the footwear holder to correspond to a shoe;

wherein the displaceable portion includes projections that in use are accepted in recesses provided on the wedge shaped footwear holder so as to lock the displaceable portion in position, and wherein the wedge shaped footwear holder includes plural recesses arranged along the neck so as to allow the displaceable portion to be located in different positions along the neck by aligning the projections to be accepted by different recesses.

10. The wedge shaped footwear holder according to claim 9 shaped for receiving an individual shoe.

11. The wedge shaped footwear holder according to claim 9, wherein the wedge shaped footwear holder is substantially or wholly formed of rigid material.

12. The wedge shaped footwear holder according to claim 9 wherein the displaceable portion includes finger grips for locating a user's hand whilst engaging and disengaging the displaceable portion in the wedge shaped footwear holder.

13. The wedge shaped footwear holder according to claim 9, wherein at least part of the wedge shaped footwear holder is transparent or translucent so as to be able to view the footwear within the wedge shaped footwear holder.

14. The wedge shaped footwear holder according to claim 9, further comprising:

a vent to permit ingress of air to the footwear inside.

* * * * *